United States Patent [19]

Bale et al.

[11] Patent Number: 4,777,967

[45] Date of Patent: Oct. 18, 1988

[54] APPARATUS FOR WRAPPING PREFORMED RODS OF SMOKING MATERIAL

[75] Inventors: Christopher R. Bale, Keynsham; Raymond A. Bryant, Yatton; Stephen J. Garrett, Somerton; Beresford R. Gill, Paulton, all of England

[73] Assignee: Imperial Tobacco Limited, England

[21] Appl. No.: 943,016

[22] Filed: Dec. 18, 1986

[30] Foreign Application Priority Data

Dec. 19, 1985 [GB] United Kingdom ..... 8531340
Apr. 18, 1986 [GB] United Kingdom ..... 8609481

[51] Int. Cl.[4] ..... A24C 5/47
[52] U.S. Cl. ..... 131/94; 131/95
[58] Field of Search ..... 131/58, 59, 94, 95

[56] References Cited

U.S. PATENT DOCUMENTS 4,103,692 8/1978 Baier et al. ..... 131/32
4,233,994 11/1980 Sass ..... 131/58
4,249,547 2/1981 Hinzmann ..... 131/58
4,303,080 12/1981 Boegli et al. ..... 131/58

FOREIGN PATENT DOCUMENTS 0017794 3/1980 European Pat. Off. .
0155514 9/1985 European Pat. Off. .
2492230 4/1982 France .
1370878 10/1974 United Kingdom ..... 131/58

*Primary Examiner*—V. Millin
*Attorney, Agent, or Firm*—Larson & Taylor

[57] ABSTRACT

An apparatus for making cigarettes from preformed rods of tobacco and precut sheets of cigarette paper comprises a rotatable fluted drum, a hopper for feeding the preformed rods to flutes in the drum, means for presenting to each rod when each flute reaches a predetermined position a precut sheet of cigarette paper that is provided along an edge with a strip of adhesive, and means for rolling the rod in the flute so that the cigarette paper is thereby wrapped round the rod and adheres to itself by means of the adhesive to form a cigarette.

18 Claims, 4 Drawing Sheets

APPARATUS FOR WRAPPING PREFORMED RODS OF SMOKING MATERIAL

This invention concerns an apparatus for wrapping a succession of preformed rods of smoking material in sheets of cigarette paper so as to form cigarettes, and enables a user to make easily by hand a number of cigarettes in, for instance, a domestic or office environment.

The term "rod of smoking material" in this specification, unless otherwise qualified, will be understood to include not only a preformed rod of smoking material by itself, but such a rod in axial abutment with a plug of filter material.

"Smoking material" in this specification will be understood to include not only tobacco, but a non-tobacco smoking material, or any combination of a non-tobacco smoking material with tobacco. Non-smokeable additives and flavours may be included in the smoking material.

According to the present invention there is provided an apparatus for wrapping a succession of preformed rods of smoking material in successive sheets of cigarette paper so as to form a plurality of cigarettes, the apparatus comprising a rotatable fluted drum, means for feeding the rods each to a respective flute in the drum, means for presenting to the rod when in said flute and when said flute has reached a predetermined position of the rotation of the drum a precut sheet of cigarette paper of predefined size that is adapted to enwrap the rod and that is provided along an edge with a strip of adhesive, and means for rolling the rod in the flute so that the cigarette paper is thereby wrapped round the rod and adheres to itself by means of the adhesive to form a cigarette.

The invention is particularly useful for wrapping preformed rods of smoking material that in the unwrapped state are inherently unsmokeable but which, when wrapped in cigarette paper, provide smokeable cigarettes.

The preformed rods of smoking material for use by the apparatus of the invention are preferably made of a smoking material such as any tobacco (cigarette, cigar, pipe or hand-rolling) intended for smoking that is formed in such a way that it is inherently incapable of being smoked until it has been overwrapped. Such preformed rods will be self-supporting and may be provided in a number of ways.

For example, smoking tobacco (which may be cut or threshed by methods known in the art) may be wrapped in a highly porous open structured paper such as teabag tissue. The product so formed will be inherently unsmokeable until it has been overwrapped in cigarette paper.

Teabag tissue is a coarse woven cellulosic web consisting of a pattern of thin areas, which in this context we shall refer to as "apertures". Typically, a teabag tissue may have about 25 "apertues" in a rectangular or diamond-shaped array per square centimetre, each "aperture" having dimensions of about 1 mm×1 mm. The typical thickness of a teabag tissue "aperture" is 1 fibre, the regions of the web separating the "apertures" being several fibers thick. The teabag tissue may be strengthened by means of strips or strings of strengthening materials such as cotton, plastics, or impermeable paper, or may be replaced by any of the following:

(a) impermeable or permeable paper that has been heavily mechanically perforated;

(b) tobacco sheet formed by known processes that has been heavily mechanically perforated;

(c) plastics (e.g. polyolefine) or natural fibre (e.g. cotton) net; or, (d) a film of adhesive.

Alternatively, the smoking material may be moulded, pressed, pelleted or extruded with carboxymethyl cellulose or starch to form a self-supporting rod that is inherently unsmokeable until it has been overwrapped.

Yet again, the product may be formed on a cigarette making machine by applying a hot melt adhesive to the smoking material and then passing the smoking material through a hot garniture to set the adhesive. Again, the product is inherently unsmokeable until it has been overwrapped.

The invention will now be described by way of example only with reference to the embodiments shown in the accompanying diagrammatic non-scale drawings in which, FIG. 1 is a schematic vertical section of a first embodiment of a rod wrapping apparatus according to the invention;

Figure 1:
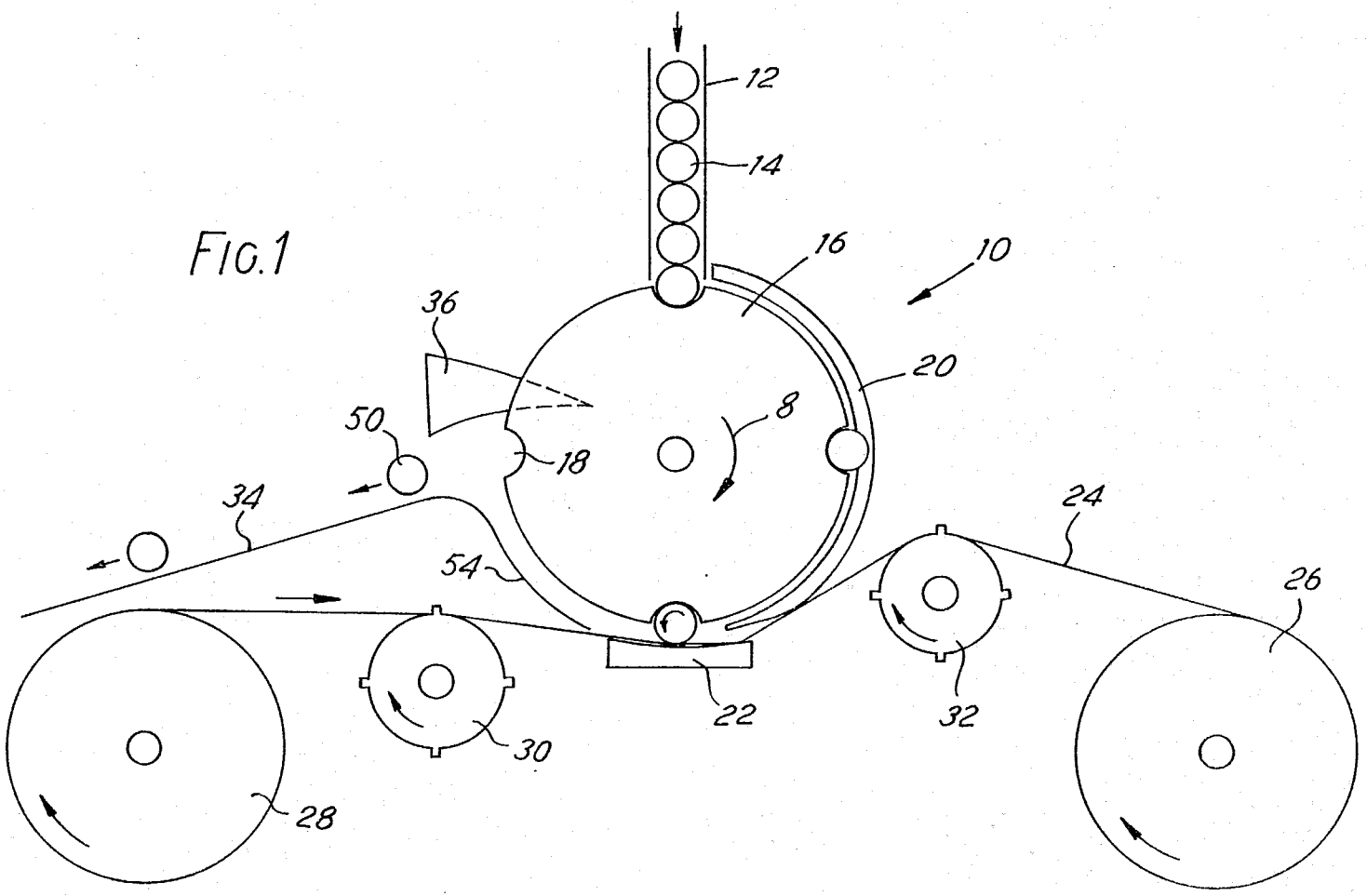

Referring to FIG. 1, there is shown generally a first embodiment of a machine or apparatus 10 for making cigarettes from rods of smoking material and filters 14 contained in separate compartments of a vertically disposed hopper 12. Each rod lies horizontally end-to-end with a corresponding filter plug. As shown, only the ends of the rods can be seen.

The apparatus includes a drum 16 rotatable about its horizontal axis in the direction of arrow 8 and provided with a series of evenly spaced circumferentially disposed flutes 18 parallel to that axis. The hopper 12 is mounted vertically above the drum so that a tobacco rod and filter 14 can each be delivered from the hopper 12 in end-to-end abutment to a flute 18.

A squash plate 20 circumferentially surrounds part of the drum 16 over 180 degrees from top to bottom and acts to bring the tobacco rod and filter into firm end-to-end abutment within the flute and to retain the tobacco rod/filter 14 in the flute while the drum rotates through 180 degrees thereby moving the flute containing the tobacco rod/filter 14 from its highest to its lowest position.

Located underneath the drum 16 diamterically opposite the hopper 12 is a rolling plate 22 which comprises a smooth stationary surface parallel to the surface of the drum but spaced radially therefrom.

Figure 2:
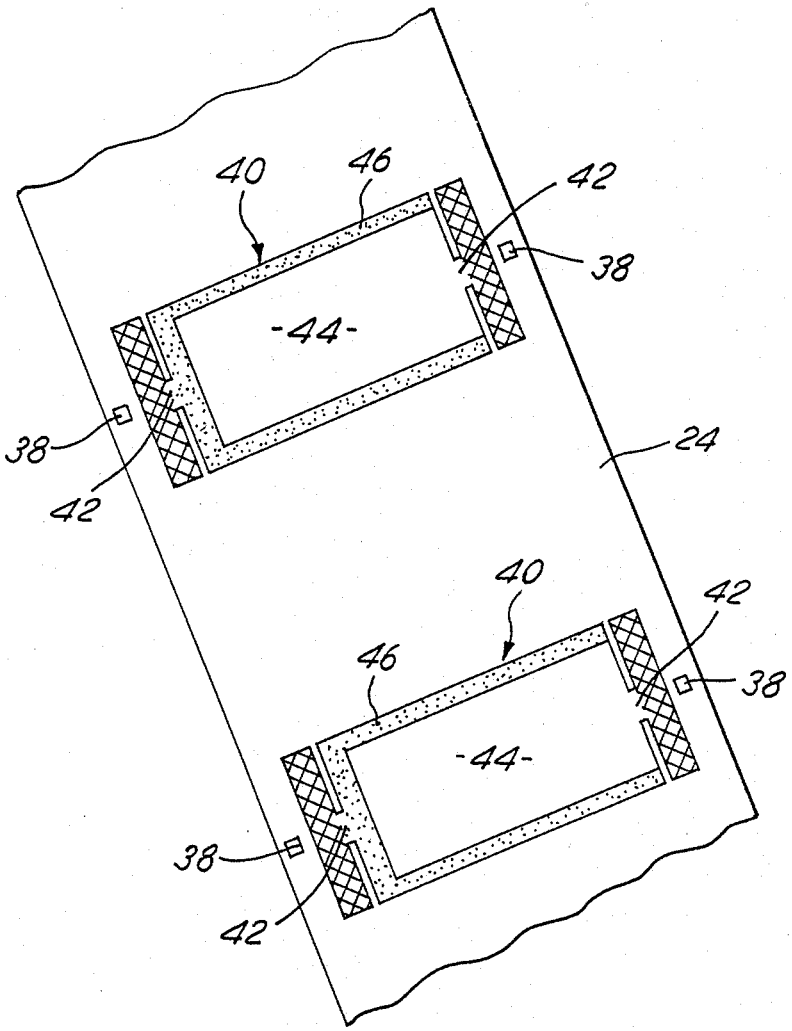
FIG. 2 is a plan view of a backing strip holding a plurality of cigarette papers.

In FIG. 2 there is shown a strip of backing paper 24 which holds a series of evenly spaced precut cigarette papers 40 of predetermined size each of which is releasably secured to the backing strip by a pair of laterally opposed tear points 42, the spacing between the sheets being equal to the spacing between successive flutes. Each cigarette paper 40 comprises an adhesive-free rectangular area 44 surrounded on three sides by a strip 46 of contact adhesive which is uppermost in relation to the backing paper 24. The backing paper is coated so that the contact adhesive will not stick to it when the backing paper is spooled. The backing strip 24 is provided with two series of registration holes 38 an opposed pair of which are adjacent each cigarette paper 40 so that the location of the cigarette papers on the backing strip 24 may be identified mechanically or optically.

In FIG. 1 the backing paper 24 together with cigarette papers is held on a feed bobbing 28, passes over a first registration drive sprocket 30, then between the rolling plate 22 and the underside of the drum 16, then over a second registration drive sprocket 32, and finally onto a rewind or take-up bobbin 26.

In operation, the hopper 12 is loaded with preformed tobacco rods and filters 14 and the backing strip 24 of cigarette papers 40 is threaded through the drive sprockets 30,32 and the rolling plate 22 and onto the take-up bobbin 26, as described above, ensuring that the registration holes 38 in the backing strip 24 match up with the drive sprockets.

Rotating the drum 16 allows a tobacco rod and filter to fall into a flute 18 in the drum wherein they are caused to abut by means of the squash plate 20, as described above. The combined rotation of the drum causes the tobacco rod/filter 14 to descent to the rolling plate 22 and removes the cigarette paper 40 from its backing strip 24 by breaking the tear points 42. The arc length of the rolling plate 22 is sufficient to cause the tobacco rod/filter 14 to roll 1.5 to 2.5 times its circumference and to ensure that the entire line of contact adhesive 46 on the cigarette paper 40 forms a lap seal on the tobacco rod/filter 14, thereby forming a cigarette 50.

The cigarette 50 so formed is carried round by the drum for a further 45 degrees rotation, being retained in contact with the drum by means of a retaining plate 54, and is then removed from the flute that carries it by means of a removal device or plate 36 engaging in a slot formed circumferentially in the drum onto an exit ramp 34 and from thence to a container (not shown).

The drum, bobbins, and registration sprockets are interconnected by means of gearing (not shown but clear to one skilled in the mechanical art) so that they operate in synchronism when the drum is rotated.

The drum may be rotated manually through a crank mechanism or alternatively may be driven by a mains or battery powered electric motor.

A second embodiment of the invention is described as follows.

Figure 3:
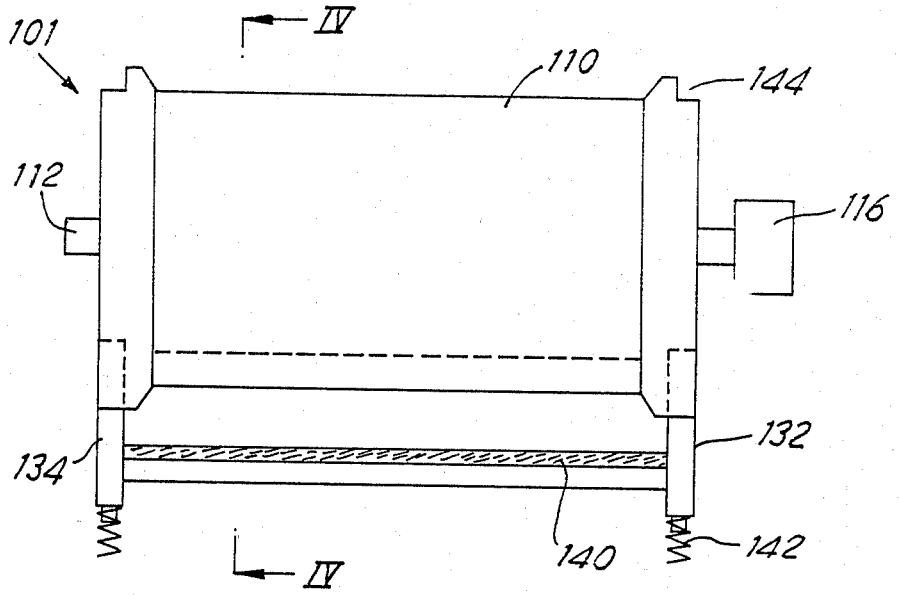
FIG. 3 is a schematic side view of a second embodiment of a rod wrapping apparatus according to the invention.
Figure 4:
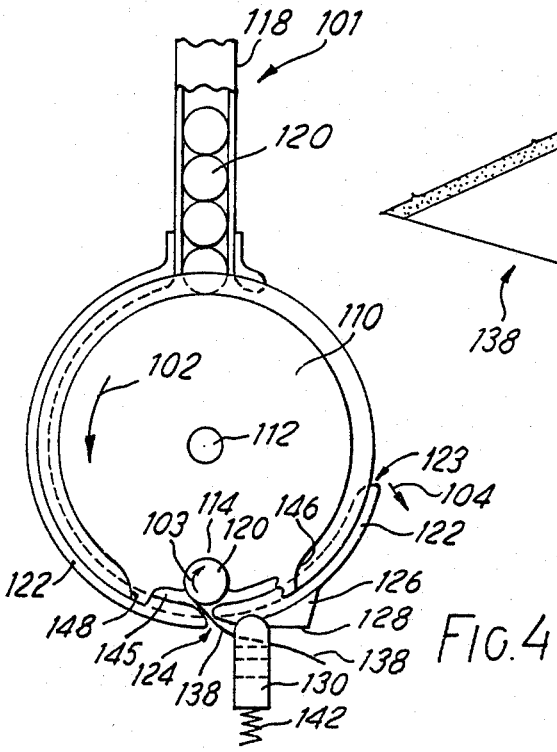
FIG. 4 is a vertical section of the apparatus of FIG. 3 taken at line IV—IV.

Referring to FIGS. 3,4 and 6 to 9 of the drawings there is shown in FIGS. 3 and 4 a tobacco rod wrapping apparatus 101 including a drum 110 provided with a longitudinal flute 114 in its circumference parallel to the axis of the drum, the drum being rotatable about an axle 112 and driven by a motor 116 or similar mechanical device such as a manually operated crank and handle, and a feed magazine 118 located vertically above the drum for storing and feeding one preformed rod 120 at a time to the flute in the drum.

As in the first embodiment, the preformed rods 120 may be preformed rods of a smoking material such as tobacco, or such rods in axial abutment with rods of filter material.

Extending round the drum 110 for about 270 degrees from feed magazine 118 in the direction of rotation 102 of the drum is a rolling and retaining plate 122 the function of which is to retain a said rod 120 in the flute 114 and to rotate the rod within the flute in the direction indicated by arrow 103. A rod 120 is able to leave the apparatus in the direction of arrow 104 when the drum 110 has rotated the flute 114 through about 270 degrees from the feed magazine 118 to a trailing end 123 of the rolling plate 122. A paper feed aperture 124 extending parallel to the axis of the drum 110 is provided in the lower portion of the rolling plate 122 opposite the feed magazine 118. The aperture 124 has a trailing edge 125 and a leading edge 127 (see FIG. 6). The trailing edge 125 is nearer the trailing end 123 of the rolling plate 122 than is the leading edge 127.

A further function of the rolling and retaining plate 122 is to bring about longitudinal abutment of a tobacco rod with a corresponding filter rod. This is achieved by providing a slight taper, in the direction of drum rotation 102, to the flanges of the rolling and retaining plate 122 such that during movement of the tobacco rod and filter rod relative to the rolling plate the tobacco rod and filter rod are urged together in close longitudinal alignment.

Adjacent the aperture 124 is a paper pinch table 126. The pinch table 126 is attached to the outside of the rolling plate 122, extends the whole length of the rolling plate, and has a flat horizontal base portion which acts as a platen 128 against which a web of paper can be pressed, as will be described hereinafter. The platen 128 of the pinch table 126 merges into an edge of the aperture 124 in the rolling plate 122.

Located underneath the rolling plate 122 and adjacent the aperture 124 in the rolling plate is a paper pinch bar assembly 130. The assembly 130 comprises a horizontally disposed pinch bar 132, and a pair of vertically disposed paper pinch bar support members 134, one at each end of the rolling plate 122, supporting the pinch bar. The pinch bar 132 and the pinch bar support members 134 define with the platen 128 of the pinch table 126 a paper feed aperture 136 (FIG. 7) through which a continuous web 138 of wrapping paper can be fed to aperture 124 in the lower part of the rolling plate 122. The upper surface of the pinch bar 132 is faced with a rubber pinch strip 140 on its upper surface. The pinch bar support members 134 are further provided with spring loading 142 which is arranged to urge the pinch bar support members together with the pinch bar 132 upwards towards the platen 128 of the pinch table 126.

The drum 110 is provided with end shoulders 144. On each end shoulder 144 is provided a cam member 145 having leading and trailing surfaces 146,148 respectively. As shown in FIGS. 3 and 6 to 9 the cam member 145 is depicted in part cut-away section. Cam surface 146, the leading edge of cam member 145, is on the leading side of the flute 114 as the drum rotates in the direction of arrow 102, and cam surface 148, the trailing edge of cam member 145, is on the trailing side of the flute. Cam member 145 is positioned so that the leading surfaces 146 on each shoulder 144 simultaneously contact their respective pinch bar support members 134 as the drum rotates, and the trailing surfaces 148 likewise simultaneously quit contact with their respective pinch bar support members when the drum continues to rotate in the direction of arrow 102.

Figure 5:
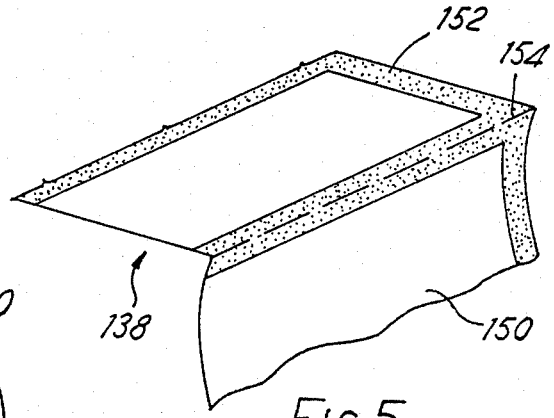
FIG. 5 is an oblique view of a web of wrapping paper for use in the apparatus of FIGS. 3 and 4; and, FIGS. 6 to 9 are various views of a part section, part cut-away, of FIG. 4 showing the apparatus in successive stages of operation.

Referring now to FIG. 5 there is shown in detail the continuous web 138 of wrapping paper which is supplied in fanfold format to the paper pinch bar assembly 130. Each section of the fanfold web 138 consists of a rectangular sheet 150 of cigarette wrapping paper, three edges of which are provided with a border 152 of contact adhesive. Individual sheets 150 in each pair of sheets are joined along a common edge by a line of weakness 154 which is adapted to be easily fractured by acute flexure. The line of weakness 154 may be provided by perforation or by partial cutting of the sheet 150.

Referring now to FIGS. 6 to 9 there are shown successive stages in the application of a sheet of wrapping paper 150 to a rod 120.

Figure 6:
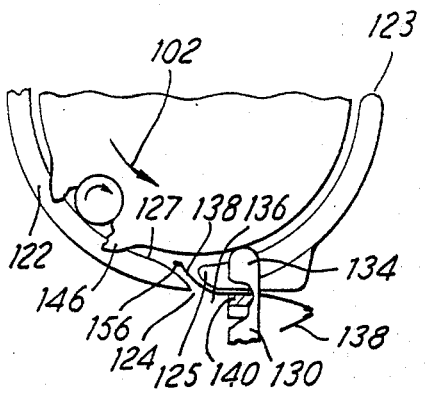

Referring to FIGS. 3 and 6, in FIG. 6 there is shown a rod 120 held in the flute 114 as the leading cam surface 146 of cam member 145 approaches the aperture 124 in the lower part of the rolling plate 122. In this configuration of the apparatus the paper pinch bar support members 134 are held against the surface of the drum 110 by virtue of the spring-loading 142 (FIG. 3). The web 138 passes through the feed aperture 136 and is held stationary against the platen 128 by the rubber pinch strip 140 pressing upwardly against the web, again by virtue of the spring-loading 142. The leading edge 156 of the web 138, which is coated with a contact adhesive 152, projects through the apertures 124 in the rolling platen 122.

Figure 7:
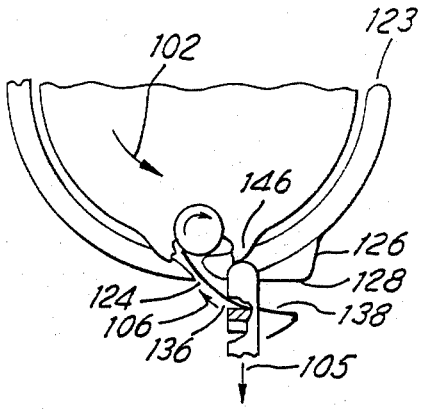

In FIG. 7 the drum 110 has rotated so that the leading cam surface 146 contacts pinch bar support member 134 and presses it down in the direction of arrow 105 against the resilience of its spring-loading 142. This releases the pressure on the web 138 against the platen 128 by the rubber pinch strip 140 and simultaneously permits the rotating rod 120 in the flute 114, which is now located over aperture 124 in the lower part of the rolling platen 122, to pick up the leading end 156 of the web 138. The adhesive-coated leading edge 156 will now adhere to the rod 120.

As the drum 110 continues to rotate, the cam member 145 continues to press the pinch bar support member 134 downward against the spring-loading 142 and permits the rotating rod 120 in the flute 114 to continue to pick up the web 138 as it moves in the direction of arrow 106. The web 138 is thus wrapped round the rod 120 and adheres thereto by virtue of the adhesive border 152.

Figure 8:
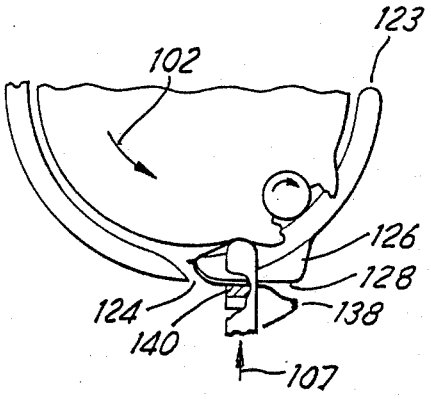

In FIG. 8 the drum 110 has rotated so that the trailing cam surface 148 of the cam member 145 permits the pinch bar support member 134 to move upwards in the direction of arrow 107 so that the rubber pinch strip 140 presses the web 138 once more against the platen 128, thus terminating the pick-up of the web by the rotating rod 120. The disposition of the parts of the apparatus and their timings are arranged so that line of weakness 154 of the web 138 lies on the trailing edge 125 of the aperture 124 in the rolling plate 122.

Figure 9:
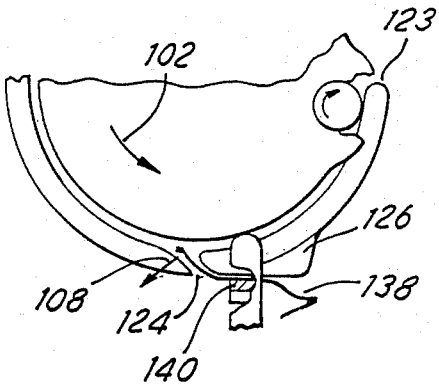

In FIG. 9 the drum 110 has rotated to a point such that the flute 114 lies just short of the trailing edge 123 of the rolling plate 122 where the wrapped rod 120 will be ejected from the apparatus. The tension on that portion of the web 138 between the edge of the aperture 124 and the rotating rod 120 will now have caused the web to fracture at the line of weakness 154 on the trailing edge 125 of the aperture, thus permitting the aforesaid portion of the web to complete its wrapping round the rod and to allow the new leading edge 156 of the web to fall back in the direction of arrow 108 against the leading edge 127 of the aperture 124 in readiness to be taken up by a rod 120 on the next revolution of the drum 110.

The second embodiment of the invention illustrated and described above produces one wrapped rod per revolution of the drum 110. However, other embodiments, not illustrated, may produce 2, 3, 4, or more wrapped rods per revolution of the drum by provision of the appropriate number of flutes 114 spaced evenly round the periphery of the drum 110.

In another version, not illustrated, of the second embodiment, the gummed wrapping paper web 138 may be attached to releasable backing paper to avoid a possible problem of adjacent sheets of wrapping paper sticking to each other when in fanfold configuration.

To aid the fall back 108 of the leading edge 156 of the web 138 onto the leading edge 127 of the aperture 124 and the subsequent pick-up by the rod 120 in the flute 114, or to prevent unwanted adhesion of the gummed surfaces of the web to the aperture 124, contact surfaces of the apparatus, e.g. the leading and trailing edges of the aperture 124 may be provided with a non-stick coating, and/or a roller may be provided.

Rod slippage in the flute 114, which could cause the next sheet of wrapping paper to be incorrectly positioned for successful pick-up by the next rod, may be minimised by the provision of light spring-loading and/or the addition of a suitable friction surface to the rolling plate 122.

In yet other versions, not illustrated, of the second embodiment, the cam member 145 may be dispensed with and the movement of the pinch bar support members controlled by pneumatic, electrical, or mechanical means synchronised with the rotation of the drum 110. The synchronisation may, for instance, be achieved by optical, electrical, pneumatic, or mechanical means, as desired.

In the embodiments of the invention the user may, if he wishes, use the apparatus to enwrap a single rod by presenting a single precut sheet of cigarette paper to the rod.

In the first embodiment the sheets of cigarette paper 40 may, if required be mounted in an imbricated arrangement on the backing strip 24. The synchronisation of the strip with the rotation of the drum will have to be modified accordingly.

In all embodiments the length of the sheet of cigarette paper to be wrapped round the preformed rod will be chosen so that it will enwrap the rod with sufficient overlap for the contact adhesive to stick the trailing edge of the paper to the cigarette. The amount of overlap necessary is well known to those skilled in the cigarette manufacturing art, and the sheets of cigarette paper will be selected to be sold and used in conjunction with a matched set of preformed rods.

The invention enables a domestic user to make as many factory quality cigarettes as he wishes for his own use in a continuous automated manner, requiring only the initial loading of a supply of rods and sheets of matching cigarette paper. The invention also avoids the need for complex equipment using fluted drums in which cigarette paper is inserted in the flutes before the tobacco is inserted.

We claim:

1. An apparatus for wrapping a succession of preformed rods of smoking material in successive sheets of cigarette paper so as to form a plurality of cigarettes, the apparatus comprising a rotatable fluted drum, means for feeding the rods each to a respective flute in the drum, means for presenting to the rod when in said flute and when said flute has reached a predetermined position of the rotation of the drum a precut sheet of cigarette paper of predefined size that is adapted to enwrap the rod and that is provided along an edge with a strip of adhesive, and means for rolling the rod in the flute so that the cigarette paper is thereby wrapped round the rod and adheres to itself by means of the adhesive to form a cigarette.

2. An apparatus as claimed in claim 1 wherein the precut sheet of cigarette paper is one of a plurality of identical sheets of cigarette paper releasably mounted in succession on a backing strip arranged to run in registration with the rotation of the drum, the spacing between the precut sheets being equal to the spacing between successive rod-containing flutes reaching said predetermined position.

3. Apparatus as claimed in claim 2 wherein the means for presenting the backing strip to bearing a sheet of cigarette paper to the rod is a rolling plate over which the backing strip passes and which frictionally engages with the rod in flute so as to roll the rod and to cause the rod to take up the sheet of cigarette paper from the backing strip.

4. Apparatus as claimed in claim 3 wherein the length of the rolling plate is arranged to cause the rod to roll sufficiently to ensure that the strip of adhesive on the cigarette paper forms a lap seal on the rod.

5. Apparatus as claimed in claim 2 wherein the backing strip and sheets of cigarette paper releasably mounted thereon is stored on a first bobbin.

6. Apparatus as claimed in claim 5 wherein there is provided a second bobbin to receive the backing strip after a sheet of cigarette paper has been wrapped round the rod.

7. Apparatus as claimed in claim 2 wherein the sheets are releably mounted on the backing strip by means of tear points.

8. Apparatus as claimed in claim 2 wherein the backing strip is held in registration with the drum by means of a sprocket feed mechanism.

9. An apparatus as claimed in claim 1 wherein the precut sheet of cigarette paper is one of a continuous strip of identical sheets of cigarette paper joined in succession by fracturable lines of weakness, and the means for presenting a sheet of cigarette paper to the rod comprises, (a) a spring loaded pinch means arranged to grip and hold stationary a first sheet of cigarette paper adjacent said predetermined position of the drum when a said flute is not at said predetermined position;

(b) a first cam means associated with the drum arranged to release said pinch means when the flute approaches said predetermined position and to permit a rod in the flute to draw said first sheet through the pinch means and on to the rod; and, (c) a second cam means associated with the drum arranged to close said pinch means on a second following sheet of cigarette paper as the flute leaves said predetermined position and permit the line of weakness between the first and second sheets to be fractured as the first sheet is wrapped round the rod.

10. Apparatus as claimed in claim 9 wherein the cam means comprise first and second cams on the drum preceding and following said flute.

11. Apparatus as claimed in claim 9 wherein the means for rolling the rod in the flute is a rolling plate extending circumferentially parallel to the drum from at least said predetermined position in the direction of rotation of the drum for a distance sufficient to ensure that the rod is wrapped in the sheet of cigarette paper, and provided with an aperture for receiving the cigarette paper from the pinch means at said predetermined position of the drum.

12. Apparatus as claimed in claim 9 wherein the pinch means comprises, (a) a platen against which a sheet of cigarette paper may be pressed, and (b) a spring-loaded pinch bar defining with the platen an aperture for receiving said sheet of cigarette paper, arranged by its spring-loading to press said sheet of cigarette paper against the platen, and actuated by said cam means.

13. Apparatus as claimed in claim 12 wherein the pinch bar is provided with a resilient facing strip to hold the sheet of cigarette paper against the platen.

14. Apparatus as claimed in claim 11 wherein the arrangement of the aperture in the rolling plate is such that the line of weakness will be fractured against an edge of the aperture.

15. Apparatus as claimed in claim 9 wherein the sheet of cigarette paper is provided with a strip of adhesive along each of three edges.

16. Apparatus as claimed in claim 1 wherein the or each strip of adhesive on the sheet of cigarette paper is a contact adhesive.

17. Apparatus as claimed in claim 1 wherein there is provided means for ejecting the cigarette from the flute.

18. Apparatus as claimed in claim 17 wherein the means for ejecting the cigarette is a plate engaging in a slot formed circumferentially in the fluted drum.

* * * * *